US006612113B2

(12) United States Patent
Guillard

(10) Patent No.: US 6,612,113 B2
(45) Date of Patent: Sep. 2, 2003

(54) INTEGRATED METHOD OF AIR SEPARATION AND OF ENERGY GENERATION AND PLANT FOR THE IMPLEMENTATION OF SUCH A METHOD

(75) Inventor: Alain Guillard, Paris (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 10/041,483

(22) Filed: Jan. 10, 2002

(65) Prior Publication Data

US 2002/0092305 A1 Jul. 18, 2002

(30) Foreign Application Priority Data

Jan. 12, 2001 (FR) ..... 01 00402

(51) Int. Cl.[7] ..... F02C 7/00

(52) U.S. Cl. ..... 60/783; 60/785; 60/39.15; 60/39.12

(58) Field of Search ..... 60/726, 772, 781, 60/783, 784, 785, 39.12, 39.15

(56) References Cited

U.S. PATENT DOCUMENTS

| | | | | |
|---|---|---|---|---|
| 4,861,369 A | | 8/1989 | von Bogdandy et al. | |
| 5,572,861 A | | 11/1996 | Shao | |
| 5,666,800 A | * | 9/1997 | Sorensen et al. | 60/39.02 |
| 5,740,673 A | | 4/1998 | Smith et al. | |
| 6,276,171 B1 | * | 8/2001 | Brugerolle | 62/646 |

OTHER PUBLICATIONS

W.K.F. Keller, "Der Gud–Prozess", *BWK Brennstoff Warme Kraft*, Dusseldorf, Germany, vol. 41, No. 9, Sep. 1, 1989, pp. 413–423.

* cited by examiner

*Primary Examiner*—Charles G. Freay
*Assistant Examiner*—John F Belena
(74) *Attorney, Agent, or Firm*—Young & Thompson

(57) ABSTRACT

In an integrated method of air separation, a plant includes at least one first air separation unit (1, 101), a first air compressor (13), a first combustion chamber (17), a first expansion turbine (19), a second air compressor (15), a second combustion chamber (23) and a second expansion turbine (25) and a third air compressor (21) in which compressed air is sent from the first air compressor to the first combustion chamber and to the first air separation unit, compressed air is sent from the second air compressor to the second combustion chamber and to the first air separation unit.

28 Claims, 2 Drawing Sheets

Figure 1:
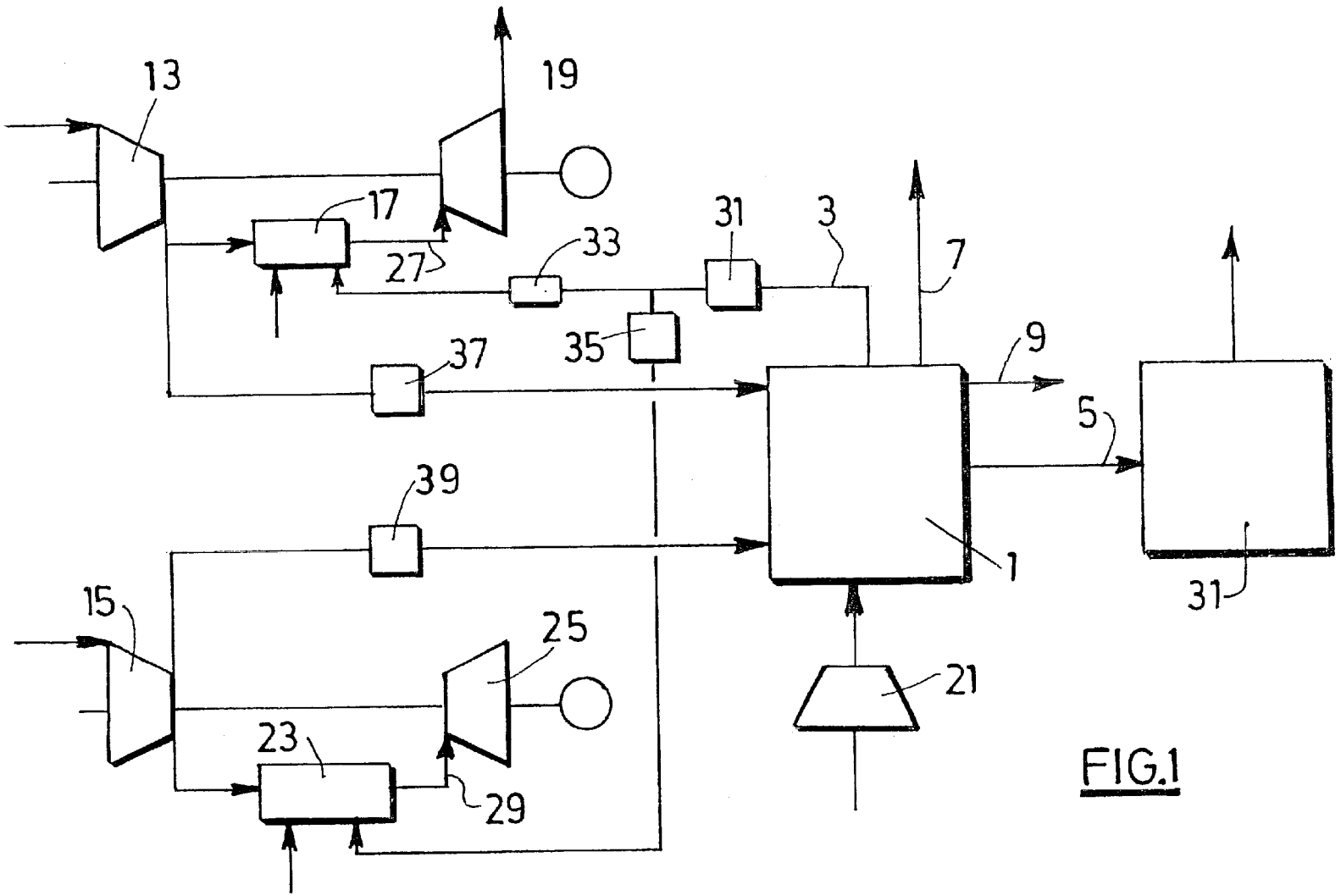

INTEGRATED METHOD OF AIR SEPARATION AND OF ENERGY GENERATION AND PLANT FOR THE IMPLEMENTATION OF SUCH A METHOD

The present invention concerns an integrated method of air separation and of energy generation and an integrated plant for the implementation of such a method.

In particular it relates to an integrated method of air separation for the production of oxygen-enriched fluid and possibly of nitrogen-enriched fluid.

It is well known to send a nitrogen-enriched gas from an air separation unit upstream of a combustion gas expansion turbine. The combustion chamber is fed with compressed air originating from an air compressor which can supply all or some of the air required by the air separation unit (ASU) as illustrated in EP-A-0538118. Alternatively as in the case of GB-A-2067668 all the air can originate from a dedicated compressor.

U.S. Pat. No. 5,664,411 shows a plant with three gas turbines and an air separation unit, the latter being fed solely by a dedicated compressor.

Generally for reasons of reliability, on one and the same site, there are two gas turbines and two air separation units which are substantially identical, producing both the impure oxygen required for the gasification of the fuels and nitrogen. Each separation unit can be fed from a gas turbine compressor and sends nitrogen solely to this same gas turbine which feeds it.

An aim of the invention is to alleviate the defects of the prior methods, in particular by allowing more flexible operation and more reliable startup. According to one object of the invention, there is provided an integrated method of air separation for the production of oxygen-enriched fluid and possibly nitrogen-enriched fluid in a plant comprising at least a first air separation unit comprising at least two distillation columns, a first air compressor, a first combustion chamber, a first expansion turbine, a second air compressor, a second combustion chamber and a second expansion turbine and a third air compressor, in which compressed air is sent from the first air compressor to the first combustion chamber and to the first air separation unit, compressed air is sent from the second air compressor to the second combustion chamber and to the first air separation unit, air is sent from the third air compressor to the first air separation unit, combustion gas is sent to the first expansion turbine from the first combustion chamber, combustion gas is sent to the second expansion turbine from the second combustion chamber and a nitrogen-enriched gas, possibly pressurized, is sent from the first air separation unit upstream of the first expansion turbine and/or upstream of the second expansion turbine.

It will be understood that the first air separation unit may be the only air separation unit of the facility or may be the first of several units.

The nitrogen-enriched gas is sent upstream of the first turbine: thus it may be sent to the combustion chamber, possibly after having being mixed with the fuel or another fluid, and/or it may be sent to the inlet of the turbine.

Preferably, an oxygen-enriched gas produced by the first air separation unit is sent to a gasification unit from which the fuel for the combustion chamber originates.

It may be useful to provide an "air bar" which is a common pipe for air streams originating from various different compressors, be they air compressors also associated with a gas turbine, air compressors dedicated to one or more air separation units.

Preferably, all the air streams intended for an air separation unit arrive there through a common pipe.

It is even possible to provide a common compressed air pipe for several air separation units.

It is preferable to mix air streams originating from at least two different compressors, upstream of the main exchanger of the separation unit or better still upstream of adsorbent beds of the air separation unit.

According to other optional and alternative aspects of the invention:

- at least 20% of the air stream treated by the first separation unit during nominal working originates from the third compressor, preferably at least 30% or 40% or 50% or 60% or 70%;
- during reduced working as compared with nominal working, the first air separation unit receives at least 90% of its air or at least 80%, preferably at least 85% or 90% or 95% of its air from the third compressor or is fed exclusively by the third compressor (this reduced working may for example be during a transient phase of a change in working, during start-up or any other phase when working is reduced, that is to say the unit produces fewer products than the maximum quantity of products that it is presumed to produce);
- during nominal working at most 70% of the air treated by the first air separation unit originates from the first and/or from the second compressor;
- during nominal working at most 50% of the air treated by the first air separation unit originates from the first and/or the second compressors;
- during nominal working at most 40% of the air treated by the first air separation unit originates from at least one of the first and second compressors;
- compressed air is supplied to a second air separation unit, producing at least one oxygen-enriched fluid and possibly at least one nitrogen-enriched fluid, via at least one of the first and second compressors, and a nitrogen-enriched gas is sent from the second air separation unit upstream of one at least of the first and second expansion turbines;
- the same compressor sends at least 80%, preferably at least 90% or even 100%, of the air which it compresses to the first and/or to the second air separation unit;
- the third compressor does not feed any combustion chamber and/or feeds only the first air separation unit;
- one dedicated compressor feeds the second air separation unit;
- the air originating from at least the first compressor is expanded or compressed upstream of the first and/or of the second air separation unit;
- the air originating from at least the second compressor () is expanded or compressed upstream of the first and/or of the second air separation unit;
- an expansion turbine for air originating from one of the first, second or third air compressors is coupled to a compressor for air originating from another of the first, second and third air compressors;
- air originating from the first compressor is mixed with air originating from the second compressor and/or air originating from the third compressor before being sent to the first air separation unit, and preferably before being purified in a single purification unit upstream of the air separation unit;
- the nitrogen-enriched gas originating from the first air separation unit is expanded or compressed upstream of one at least of the first and second expansion turbines;

the nitrogen-enriched gas originating from the second air separation unit is expanded or compressed upstream of one at least of the first and second expansion turbines;

an expansion turbine for nitrogen-enriched gas originating from one of the air separation units is coupled with a compressor for nitrogen-enriched gas originating from the other air separation unit.

According to another object of the invention, there is provided an integrated plant for air separation for producing an oxygen-enriched fluid and possibly a nitrogen-enriched fluid, comprising at least one first air separation unit comprising at least two distillation columns, a first air compressor, a first combustion chamber, a first expansion turbine, a second air compressor, a second combustion chamber and a second expansion turbine and a third air compressor, means for sending compressed air from the first air compressor to the first combustion chamber and to the first air separation unit, means for sending compressed air from the second air compressor to the second combustion chamber and to the first air separation unit, means for sending air from the third air compressor to the air separation unit, means for sending combustion gas to the first expansion turbine from the first combustion chamber, means for sending combustion gas to the second expansion turbine from the second combustion chamber and means for sending a nitrogen-enriched gas from the first air separation unit upstream of the first expansion turbine and/or upstream of the second expansion turbine.

According to other optional aspects of the invention, the plant comprises:

a second air separation unit producing at least one oxygen-enriched fluid and possibly at least one nitrogen-enriched fluid, means for supplying compressed air to the second air separation unit via at least one of the first and second compressors and means for sending a nitrogen-enriched gas from the second air separation unit upstream of one at least of the first and second expansion turbines;

means for expanding or compressing the air originating from at least one of the first and second compressors upstream of the first and/or of the second air separation unit;

means for expanding or compressing the nitrogen-enriched gas originating from at least one of the first and second air separation units upstream of one at least of the first and second expansion turbines.

Preferably, the third compressor is not connected to a combustion chamber and/or is connected only to the first air separation unit.

Preferably a dedicated compressor is connected to the second air separation unit.

The same compressor is possibly connected so as to send air to the first and to the second air separation unit.

The plant may comprise means for expanding or compressing the air originating from the first compressor upstream of the first and/or of the second air separation unit and/or means for expanding or compressing the air originating from the second compressor upstream of the first and/or of the second air separation unit.

In this case, the plant may comprise at least one expansion turbine, means for sending air from one of the first and second compressors to the turbine, a compressor, means for sending air from the other of the first and second compressors to the turbine and means for coupling between the turbine and the compressor.

Likewise, the plant may comprise means for expanding or compressing the nitrogen-enriched gas originating from the first air separation unit upstream of one at least of the first and second expansion turbines and/or means for expanding or compressing the nitrogen-enriched gas originating from the second air separation unit upstream of one at least of the first and second expansion turbines.

In this case, the plant may comprise at least one expansion turbine, means for sending nitrogen-enriched gas from one of the first and second air separation units to the turbine, a compressor, means for sending nitrogen-enriched gas from the other of the first and second air separation units to the turbine and means for coupling between the turbine and the compressor.

A plant according to the invention which is able to operate a method according to the invention is illustrated diagrammatically in FIG. 1.

Figure 2:
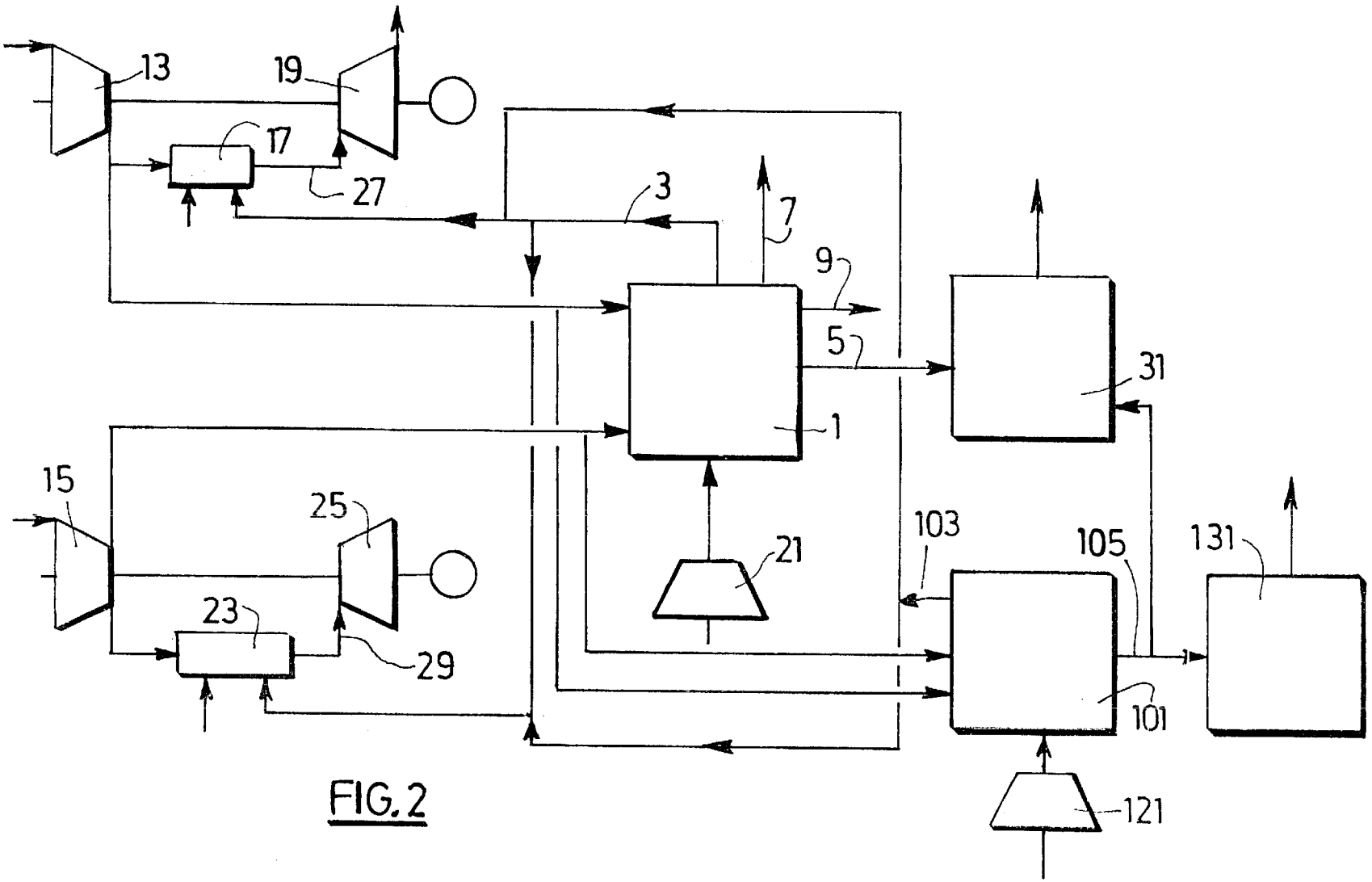

A second plant according to the invention incorporating two air separation units is illustrated diagrammatically in FIG. 2.

An air separation unit 1 comprises at least two cryogenic distillation columns (not illustrated). It may for example comprise three columns, one of which is a high-pressure column, one a low-pressure column and one an intermediate-pressure column. A unit of this kind is described in EP-A-0538118. Alternatively or additionally it may comprise a mixing column and/or an argon production column. It produces nitrogen-enriched gas, customarily called waste gas 3, an oxygen-enriched gas at a high pressure 5, another nitrogen-enriched gas 7 and possibly one or more liquid products 9 and/or an argon-enriched fluid 11.

The air feed to this unit is achieved from one or more air compressors.

A first air compressor 13 supplies air to the air separation unit 1 and to a first combustion chamber 17, whose combustion gases feed a first expansion turbine 19 which generates electricity.

A second air compressor 15 supplies air to the air separation unit 1 and to a second combustion chamber 23, whose combustion gases feed a second expansion turbine 25 which generates electricity. A third air compressor 21 supplies air exclusively to the air separation unit.

During reduced working the air separation unit 1 receives at least 90% of its air from the compressor 21.

The means for cooling the air from the exit temperature of the compressors 13, 15 to a temperature close to ambient upstream of the air separation unit 1 are not illustrated.

The waste gas 3 from the separation unit may be sent upstream of the first and/or the second turbine, for example to the first and/or to the second combustion chamber or to the inlet of the first and/or the second turbine.

Optionally, the unit may comprise means for modifying the pressure of the waste gas 3, such as one or more compressors 31, 33, 35 shown dashed. Likewise, there may be a pressure modification means 37 on the line conveying the air from the compressor 13 to the air separation unit (ASU) and/or a pressure modification means 39 on the line conveying the air from the compressor 15 to the ASU 1. This means may consist of a compressor, an expansion valve or a turbine. There may be a pressure boosting means 37 on the line conveying the air from the compressor 13 to the ASU 1 and/or a pressure reducing means 39 on the line conveying the air from the compressor 15 to the ASU 1 or alternatively, a pressure reducing means 37 on the line conveying the air from the compressor 13 to the ASU 1 and a pressure boosting means 39 on the line conveying the air from the compressor 15 to the ASU 1.

The oxygen-enriched pressurized gas is preferably sent to one or more gasifiers where it serves to produce fuel for at least one of the combustion chambers 17, 23.

The compressors 13, 15, 21 may supply air at different pressures, for example differing from one another by at least 1 bar. The streams at the higher pressures may be expanded to the lower pressure so as to purify all the air streams together. The levels of charge of the gas turbines may be different.

Otherwise, the streams may be sent to columns of the ASU operating at different pressures and/or purified, each at their optimal pressure.

In the plant of FIG. 2, there are two air separation units 1, 101, each having at least two distillation columns and each possibly having its own cold box.

The unit 1 produces the same products as those described hereinabove: the unit 101 produces at least residue nitrogen 103 and oxygen-enriched gas under high pressure.

The residue nitrogen 103 can be sent to the first and/or the second combustion chamber or alternatively can be exhausted to atmosphere, used for the regeneration of the purifications of first and/or second units 1, 101 or used in some other way.

The oxygen 105 may be sent to another gasifier 131, the gasifier 31 or another utilization, especially if its purity is different from that of the oxygen 5.

The unit 101 is fed with air from a compressor 121, possibly dedicated, and possibly from the first compressor 13 and/or the second compressor 15 and/or the dedicated compressor 21.

Optionally, as shown in FIG. 1, the plant may comprise means 103 for modifying the pressure of the waste gas 3, 103, such as one or more compressors. Likewise, there may be a pressure modification means on the line conveying the air from the compressor 13 to the ASU 1 or the ASU 101 and/or a pressure modification means on the line conveying the air from the compressor 15 to the ASU 1 and/or the ASU 101. This means may consist of a compressor, an expansion valve, or a turbine. There may be a pressure boosting means on the line conveying the air from the compressor 13 to the ASU 1 and/or the ASU 101 and/or a pressure reducing means 39 on the line conveying the air from the compressor 15 to the ASU 1 and/or the ASU 2 or alternatively, a pressure reducing means 37 on the line conveying the air from the compressor 13 to the ASU 1 and/or the ASU 101 and a pressure boosting means 39 on the line conveying the air from the compressor 15 to the ASU 1 and/or the ASU 2.

What is claimed is:

1. Integrated method of air separation for the production of oxygen-enriched fluid and possibly nitrogen-enriched fluid in a plant comprising at least a first air separation unit (1) comprising at least two distillation columns, a first air compressor (13), a first combustion chamber (17), a first expansion turbine (19), a second air compressor (15), a second combustion chamber (23) and a second expansion turbine (25) and a third air compressor (21), in which compressed air is sent from the first air compressor to the first combustion chamber and to the first air separation unit, compressed air is sent from the second air compressor to the second combustion chamber and to the first air separation unit, air is sent from the third air compressor to the first air separation unit, combustion gas (27) is sent to the first expansion turbine from the first combustion chamber, combustion gas (29) is sent to the second expansion turbine from the second combustion chamber and a nitrogen-enriched gas (3), possibly pressurized, is sent from the first air separation unit upstream of the first expansion turbine and/or upstream of the second expansion turbine.

2. Method according to claim 1, in which at least 20% of the air stream treated by the first separation unit (1) during nominal working originates from the third compressor (21).

3. Method according to claim 2, in which during reduced working as compared with nominal working, the first air separation unit (1) receives at least 80% of its air from the third compressor (21).

4. Method according to claim 1, in which during nominal working at most 80% of the air treated by the first air separation unit (1) originates from the first and/or from the second compressor (13, 15).

5. Method according to claim 4, in which during nominal working at most 50% of the air treated by the first air separation unit (1) originates from the first and/or the second compressor (13, 15).

6. Method according to claim 5, in which during nominal working at most 40% of the air treated by the first air separation unit (1) originates from at least one of the first and second compressors (13, 15).

7. Method according to claim 1, in which compressed air is supplied to a second air separation unit (101), producing at least one oxygen-enriched fluid and possibly at least one nitrogen-enriched fluid, via at least one of the first and second compressors (13, 15) and possibly via the third compressor (21), and a nitrogen-enriched gas (103) is sent from second air separation unit upstream of one at least of the first and second expansion turbines (19, 25).

8. Method according to claim 7, in which the same compressor (21) sends at least 80% of the air which it compresses exclusively to the first and/or to the second air separation unit (1, 101).

9. Method according to claim 1, in which the third compressor (21) does not feed any combustion chamber and/or feeds only the first air separation unit. (1).

10. Method according to claim 1, in which at least one dedicated compressor (21, 121) feeds at least the second air separation unit (101).

11. Method according to claim 1, in which the air originating from at least the first compressor (13) is expanded or compressed upstream of the first and/or of the second air separation unit (1, 101).

12. Method according to claim 1, in which the air originating from at least the second compressor (15) is expanded or compressed upstream of the first and/or of the second air separation unit (1, 101).

13. Method according to claim 11, in which an expansion turbine for air originating from one of the first, second or third air compressors (13, 15, 21, 121) is coupled to a compressor for air originating from another of the first, second or third air compressors (13, 15, 21, 121).

14. Method according to claim 1, in which air originating from the first compressor (13) is mixed with air originating from the second compressor (15) and/or air originating from the third compressor (21) before being sent to the first air separation unit (1), and preferably before being purified in a single purification unit upstream of the air separation unit.

15. Method according to claim 1, in which the nitrogen-enriched gas (3) originating from the first air separation unit (1, 101) is expanded or compressed upstream of one at least of the first and second expansion turbines (19, 25).

16. Method according to claim 1, in which the nitrogen-enriched gas (103) originating from the second air separation unit (1, 101) is expanded or compressed upstream of one at least of the first and second expansion turbines (19, 25).

17. Method according to claim 15, in which an expansion turbine for nitrogen-enriched gas originating from one of the air separation units is coupled with a compressor for nitrogen-enriched gas originating from the other air separation unit.

18. Integrated plant for air separation comprising at least one first air separation unit (1, 101) producing an oxygen-enriched fluid and possibly a nitrogen-enriched fluid, comprising at least two distillation columns, a first air compressor (13), a first combustion chamber (17), a first expansion turbine (19), a second air compressor (15), a second combustion chamber (23) and a second expansion turbine (25) and a third air compressor (21), means for sending compressed air from the first air compressor to the first combustion chamber and to the first air separation unit, means for sending compressed air from the second air compressor to the second combustion chamber and to the first air separation unit, means for sending air from the third air compressor to the first air separation unit, means for sending combustion gas (27) to the first expansion turbine from the first combustion chamber, means for sending combustion gas (29) to the second expansion turbine from the second combustion chamber and means for sending a nitrogen-enriched gas (3) from the first air separation unit upstream of the first expansion turbine and/or upstream of the second expansion turbine.

19. Plant according to claim 18, comprising a second air separation unit (101) producing an oxygen-enriched fluid and possibly a nitrogen-enriched fluid, means for supplying compressed air to the second air separation unit via at least one of the first and second compressors (13, 15) and means for sending a nitrogen-enriched gas (103) from the second air separation unit upstream of one at least of the first and second expansion turbines.

20. Plant according to claim 18, in which the same compressor (21) is connected so as to send air to the first and to the second air separation units.

21. Plant according to claim 18, in which the third compressor (21) is not connected to a combustion chamber and/or is connected only to the first air separation unit (1).

22. Plant according to claim 18, in which a dedicated compressor (121) is connected to the second air separation unit.

23. Plant according to claim 18, comprising means (37, 39) for expanding or compressing the air originating from the first compressor upstream of the first and/or of the second air separation unit.

24. Plant according to claim 18, comprising means (37, 39) for expanding or compressing the air originating from the second compressor upstream of the first and/or of the second air separation unit.

25. Plant according to claim 23, comprising at least one expansion turbine, means for sending air from one of the first and second compressors to the turbine, a compressor, means for sending air from the other of the first and second compressors to the turbine and means for coupling between the turbine and the compressor.

26. Plant according to claim 18, comprising means (31, 33, 35) for expanding or compressing the nitrogen-enriched gas originating from the first air separation unit upstream of one at least of the first and second expansion turbines.

27. Plant according to claim 18, comprising means (31, 33, 35) for expanding or compressing the nitrogen-enriched gas originating from the second air separation unit upstream of one at least of the first and second expansion turbines.

28. Plant according to claim 26, comprising at least one expansion turbine, means for sending nitrogen-enriched gas from one of the first and second air separation units to the turbine, a compressor, means for sending nitrogen-enriched gas from the other of the first and second air separation units to the turbine and means for coupling between the turbine and the compressor.

* * * * *